US006655818B2

(12) United States Patent
Liu

(10) Patent No.: US 6,655,818 B2
(45) Date of Patent: Dec. 2, 2003

(54) STRUCTURE OF TWISTED FLEXIBLE LIGHTS

(76) Inventor: Tzu-Chen Liu, P.O. Box 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/041,456

(22) Filed: Jan. 10, 2002

(65) Prior Publication Data

US 2003/0128541 A1 Jul. 10, 2003

(51) Int. Cl.[7] ..... F21S 13/14

(52) U.S. Cl. ..... 362/252; 362/806; 362/238; 362/152

(58) Field of Search ..... 362/252, 231, 362/228, 806, 238, 389, 152

(56) References Cited

U.S. PATENT DOCUMENTS 5,788,361 A * 8/1998 Lee ..... 362/249

* cited by examiner

*Primary Examiner*—Stephen Husar
*Assistant Examiner*—Sharon Payne

(57) ABSTRACT

A structure of twisted flexible lights mainly includes a flexible light with pearlescent or other color pigments and a connector buried vertically; wherein, a plurality of strands of flexible lights are twisted together to make a colorful flexible light and that is further formed into an arcuate shape, an arch or crisscrossed arcuate shapes to be mounted onto the vertically buried connector thereby to make the style of the flexible light variable and the features thereof colorful, gorgeous and not easy to fade so as to achieve the practical and beautiful effect.

2 Claims, 9 Drawing Sheets

STRUCTURE OF TWISTED FLEXIBLE LIGHTS

BACKGROUND OF THE INVENTION

1) Field of the Invention

The present invention relates to a structure of twisted flexible lights mainly possessing the features of being capable of making various style variations, colorful, gorgeous and not easy to fade so as to achieve the practical and beautiful effect.

2) Description of the Prior Art

Accordingly, the style of a conventional flexible light has only been changed at a small scale and most of the surface tinges thereof are dominated by the traditional and monochrormic blue, green, purple, yellow, red and pink colors; that makes the conventional flexible light look very boring and without uniqueness; furthermore, after a long-term usage, the surface tinges of the conventional flexible light tend to fade and thereby affects the visional effect of the entire flexible light; in addition, most of the conventional flexible lights are segmented, grouped and require separate accords and that increases the material cost and consumes the resources.

In view of the abovementioned shortcomings of the conventional flexible light, the inventor of the present invention, based on the spirit of innovation and searching for the best with tile professional perspective and knowledge, developed tile present invention of a structure of twisted flexible lights with more practicality and wider application scope to meet the value of industrial utilization.

SUMMARY OF THE INVENTION

The present invention mainly twists two or three strands of flexible lights with pealescent or other colorful pigments together to make a colorful flexible light and that is further formed into an arcuate shape, an arch or crisscrossed arcuate shapes to be mounted onto a vertically buried connector; the said vertically buried connector comprises a slot seat, a plastic peg, an iron nail, a joint and a connector; wherein the plastic pegs are mounted at the lower aspect of a plurality of protruding hole disposed on the bottom portion of the slot seat; then the iron nail is inserted through the protruding hole at the bottom portion of the slot seat and the hollow area inside the plastic peg for fastening and jointing the slot seat and the plastic peg; then the connector is jointed with the joint of the twisted colorful flexible lights and slid inwardly through the concaved slot disposed on two lateral sides at the upper aspect of the joint of the twisted colorful flexible lights toward bar rails formed by the upper rims on two lateral planes of the slot seat, thereby to install the joint and the connector inside the slot seat to be fastened by a screw; finally, an AC cord receptacle disposed on one side of the connector is plugged into an AC cord socket.

The primary objective of the present invention is to twist the said two or three strands of flexible lights with pearlescent or other colorful pigments together to make the flexible lights have the features of being colorful, gorgeous and not easy to fade.

The secondary objective of the present invention is to design the connector to be buried vertically allowing the flexible lights to be formed into an arcuate shape an arch or crisscrossed arcuate shapes for various variations.

Another objective of the present invention is to design the connector to be buried vertically to require only one end to be electrically connected for conducting all of the flexible lights to luminesce.

To enable a further understanding of the objectives, features and functions of the present invention, the brief description of the drawings below is followed by the detailed description of the preferred embodiment.

DETAILED DESCRIPTION OF THE PREFERRED EMBODIMENTS

Figure 1:
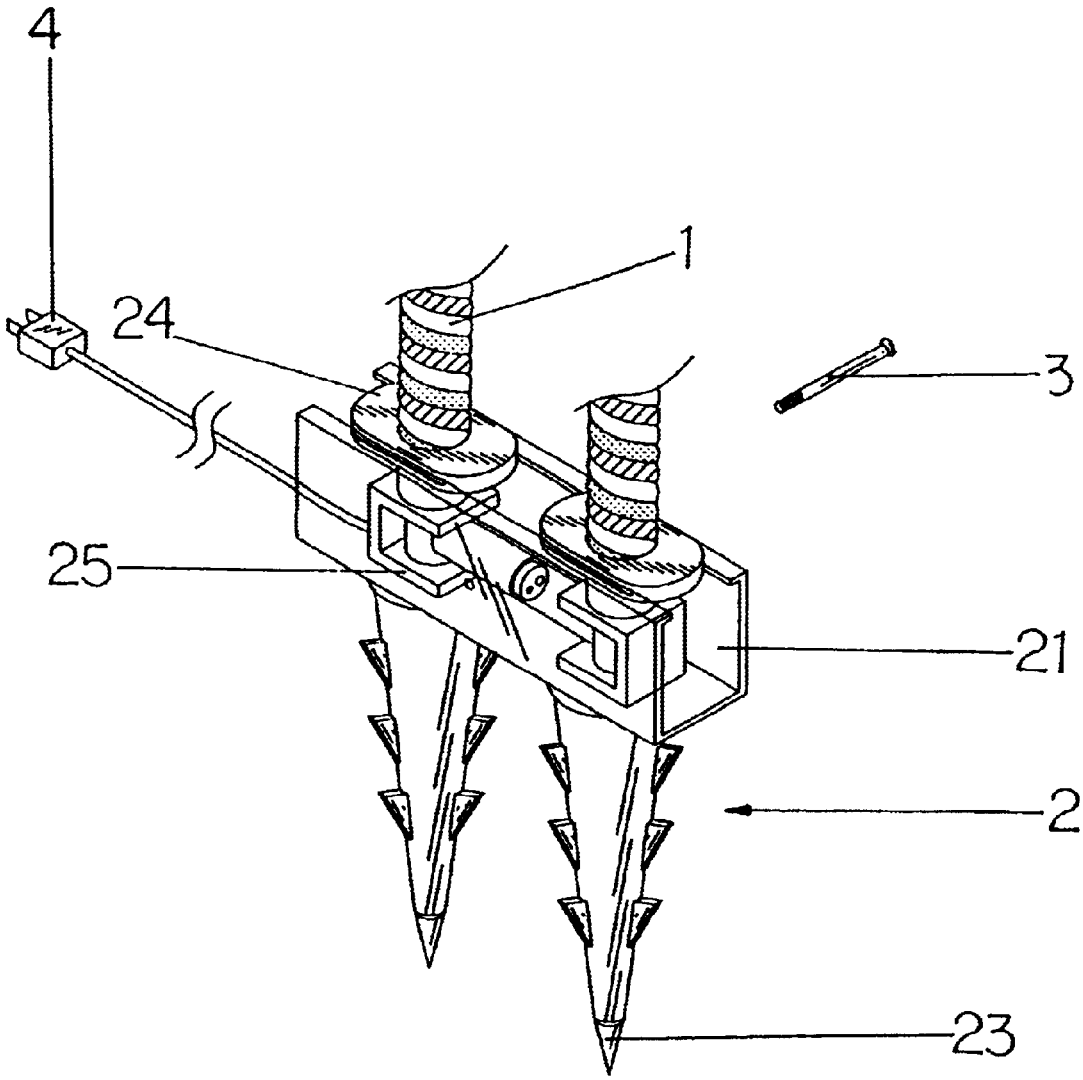
FIG. 1 is a pictorial drawing of the present invention.
Figure 2:
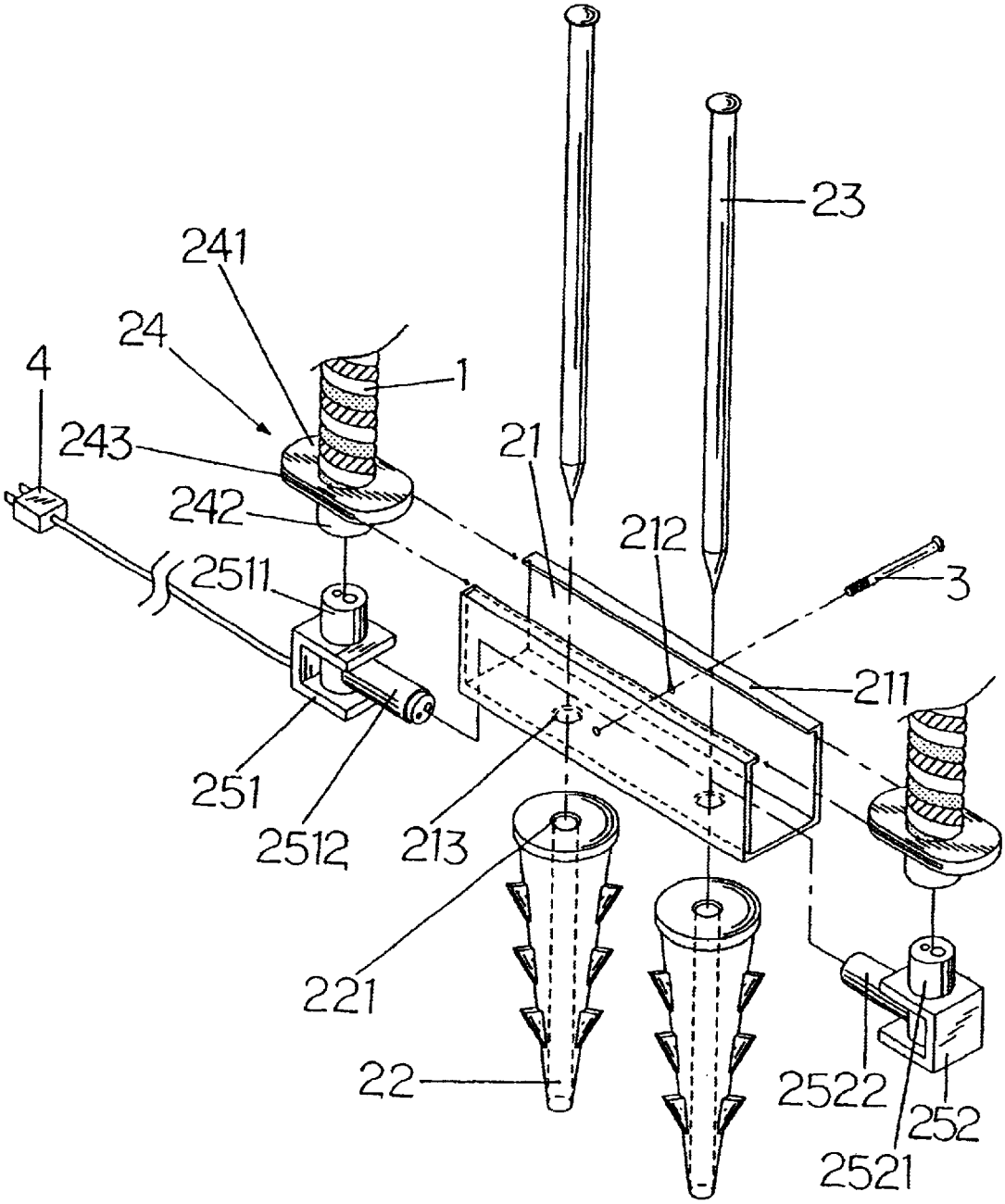
FIG. 2 is an exploded and pictorial drawing of the present invention.

Referring to FIGS. 1 and 2, the pictorial drawing as well as the exploded and pictorial drawing of the present invention, the present invention, mainly making the style of the flexible lights variable to have the features of being colorful, gorgeous and not easy to fade, comprises a flexible light (1) with pearlescent or other color pigments spread on the surface thereof and a vertically buried connector (2); wherein two or three strands of flexible lights (1) are twisted together to form a colorful flexible light (1) to be formed into an accuate shape, an arch or crisscrossed arcuate shapes to be mounted onto the vertically buried connector (2) and that comprises an "U" shaped slot seat (21) punch-made by metal material and spread by polyvinyl chloride (PVC) for antirust; the upper rims of two lateral planes thereof extend inwardly to form bar rails (211) with threaded holes (212) disposed at the proper areas on two lateral planes for a screw (3) to insert through and fasten; the left and the right sides on the bottom portion of the slot seat (21) are respectively disposed with a protruding hole (213); plastic pegs (22) are mounted at the lower aspect of the protruding holes (213) disposed on the bottom portion of the said slot seat (21); the plastic pegs (22) are injected and squeezed to mold into the shapes of an inner triangle with saw teeth; the center thereof is a hollow area (221) corresponding to the protruding holes (213) on the bottom portion of the slot scat (21); an iron nail (23) inserts through both the protruding hole (213) on the bottom portion of the slot seat (21) and the hollow area (221) of the plastic peg (22) for fastening the slot seat (21) and the plastic peg (22); a joint (24) has an oval and flat upper aspect (241), a cylindrical post extended from the lower aspect (242) and a hollow area (not shown) at the center for one end joint of the said twisted flexible lights (1) to insert into; wherein, two lateral sides of the upper aspect (241) of the said joint (24) arc respectively disposed with a concave slot (243) corresponding to the bar rails (211) formed by the upper rims of two lateral planes of the said slot seat (21) for sliding the joint (24) into the slot scat (21); a connector (25) separately disposed in type male A and type female B is mounted in the said slot seat (21) in sandwiched and opposite "L" shapes; wherein, one end of the type male A connector (251) is disposed with an AC cord receptacle (4) for connecting with an AC cord socket but the type female B connector (252) is not; the upper and the lower ends of the said type male A and type female B connectors (251, 252) are respectively disposed with a connecting joint with a set of negative conducting tube and a positive conducting post disposed inside; wherein, the said upper end connecting joints (2511, 2521) are jointed to the lower aspect (242) of the said joint (24) to make the negative conducting tube and the positive conducting post of the twisted flexible lights (1) inside the joint (24) electrically conduct with the negative conducting tube and the positive conducting post inside the upper connecting joints (2511, 2521); the lower connecting joints (2512, 2522) arc correspondingly jointed with type male A and type female B connectors (251, 251) for supplying electricity to the flexible lights (1) inserted on the type female B connector (252).

Figure 3:
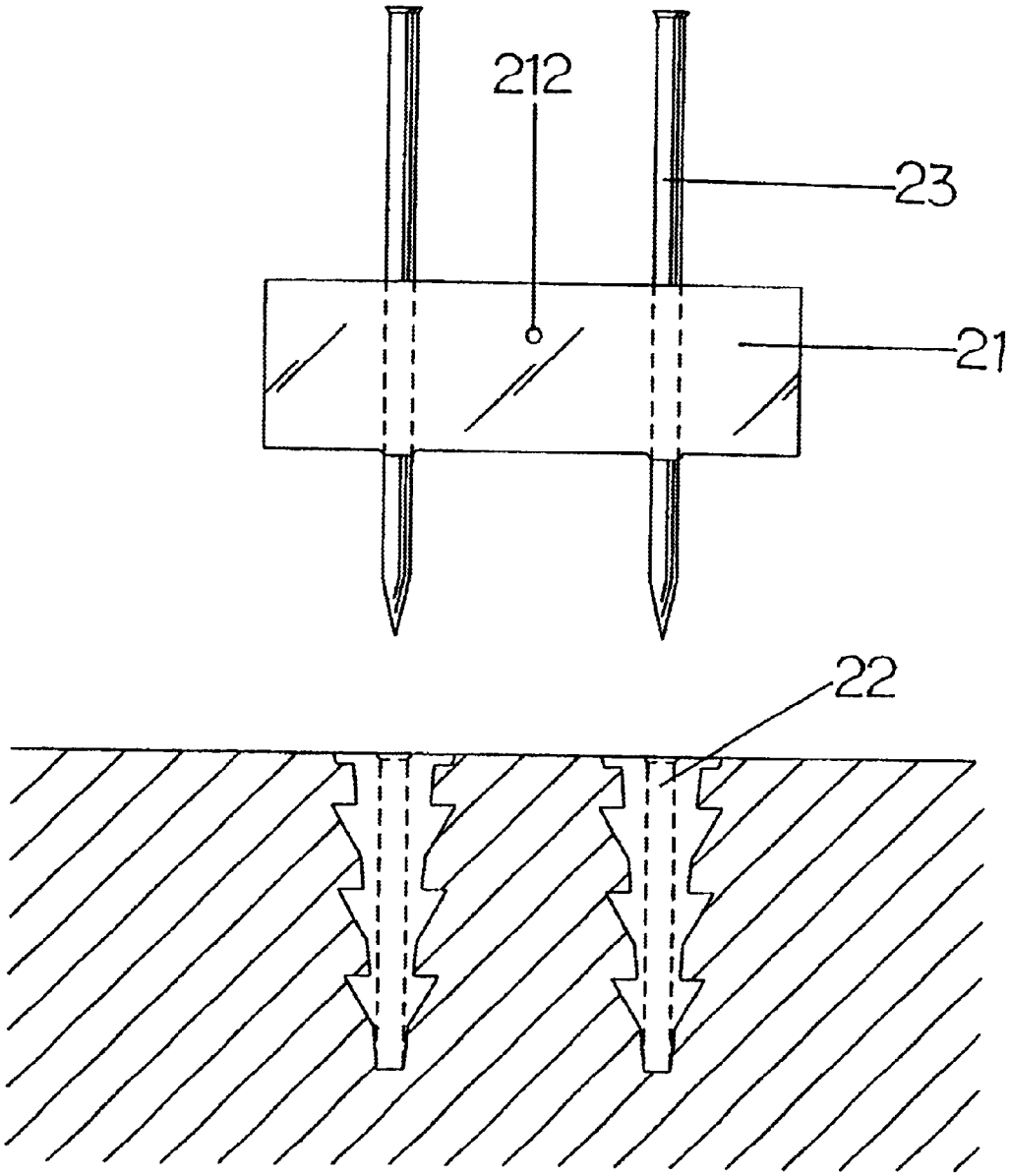
FIG. 3 is a drawing of the dissembled state of a slot seat, a plastic peg and an iron nail of the present invention.
Figure 4:
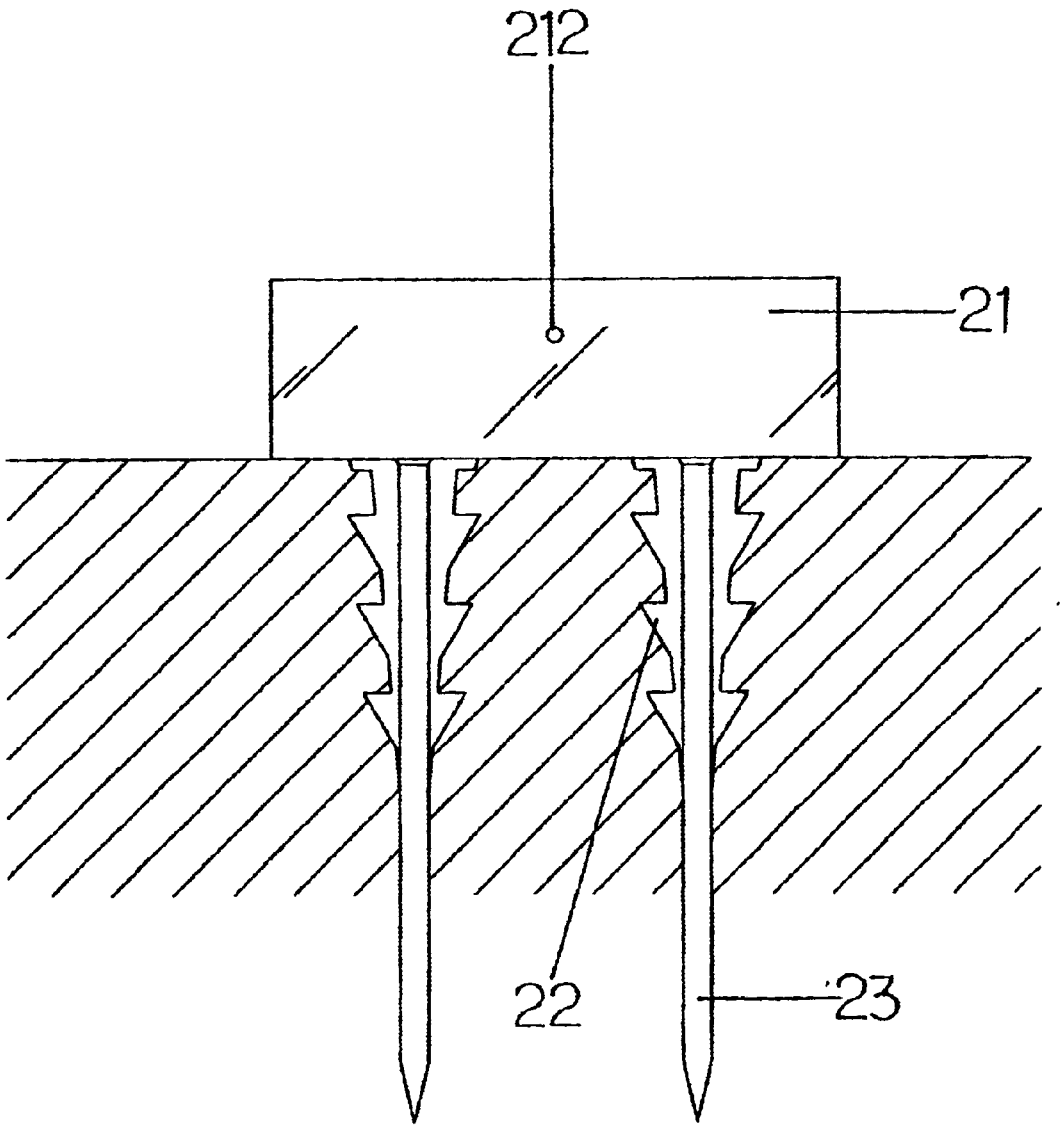
FIG. 4 is a drawing of the assembled state of a slot seat, a plastic peg and an iron nail of the present invention.

According to the abovementioned, when assembling the present invention, first, the plastic peg (22) is placed at the lower aspect of the protruding hole (213) disposed on the bottom portion of the slot seat (21); then the iron nail (23) is inserted through the protruding hole (213) disposed on the slot seat (21), as shown in FIG. 3, to be further inserted into the hollow area (221) inside the plastic peg (22); then the iron nail (23) is hammered to bury the plastic peg (22) into the ground, as shown in FIG. 4; since the plastic peg (22) is in the shape of an inner triangle with saw teeth, it can hold very firmly.

Figure 5:
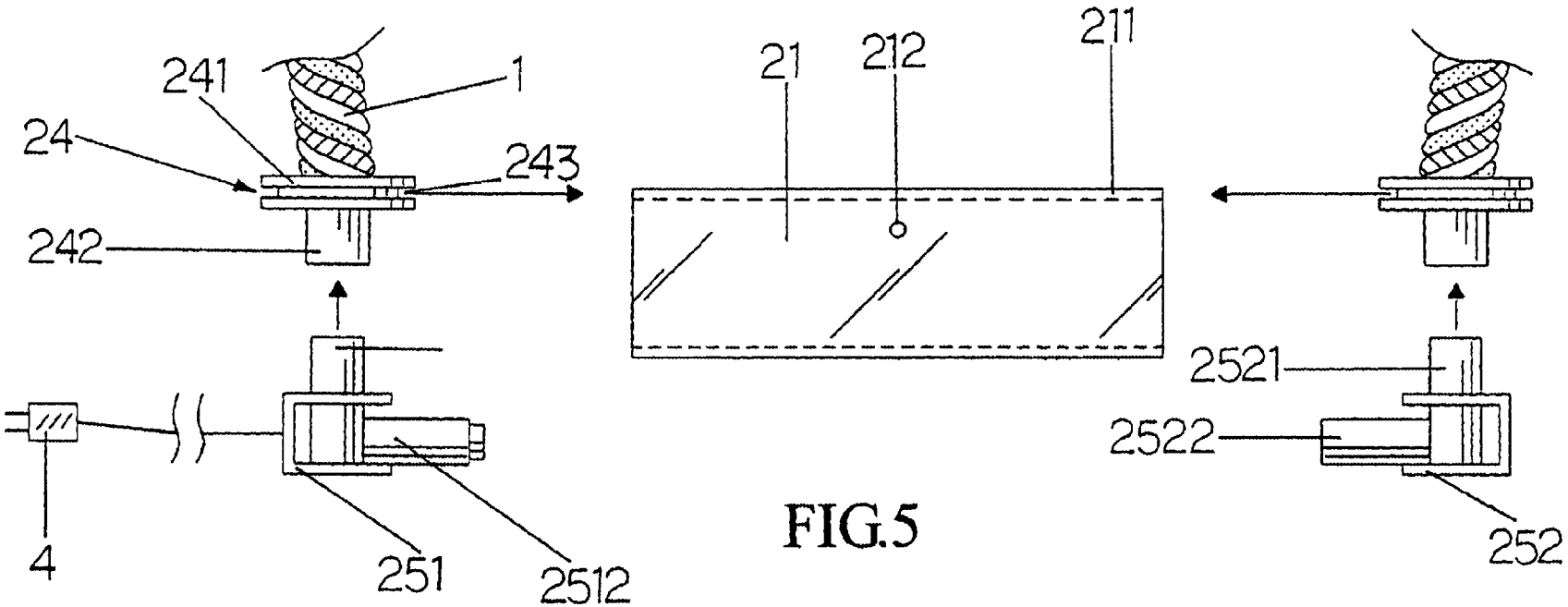
FIG. 5 is a drawing of the dissembled state of a slot seat, a joint and a connector of the present invention.
Figure 6:
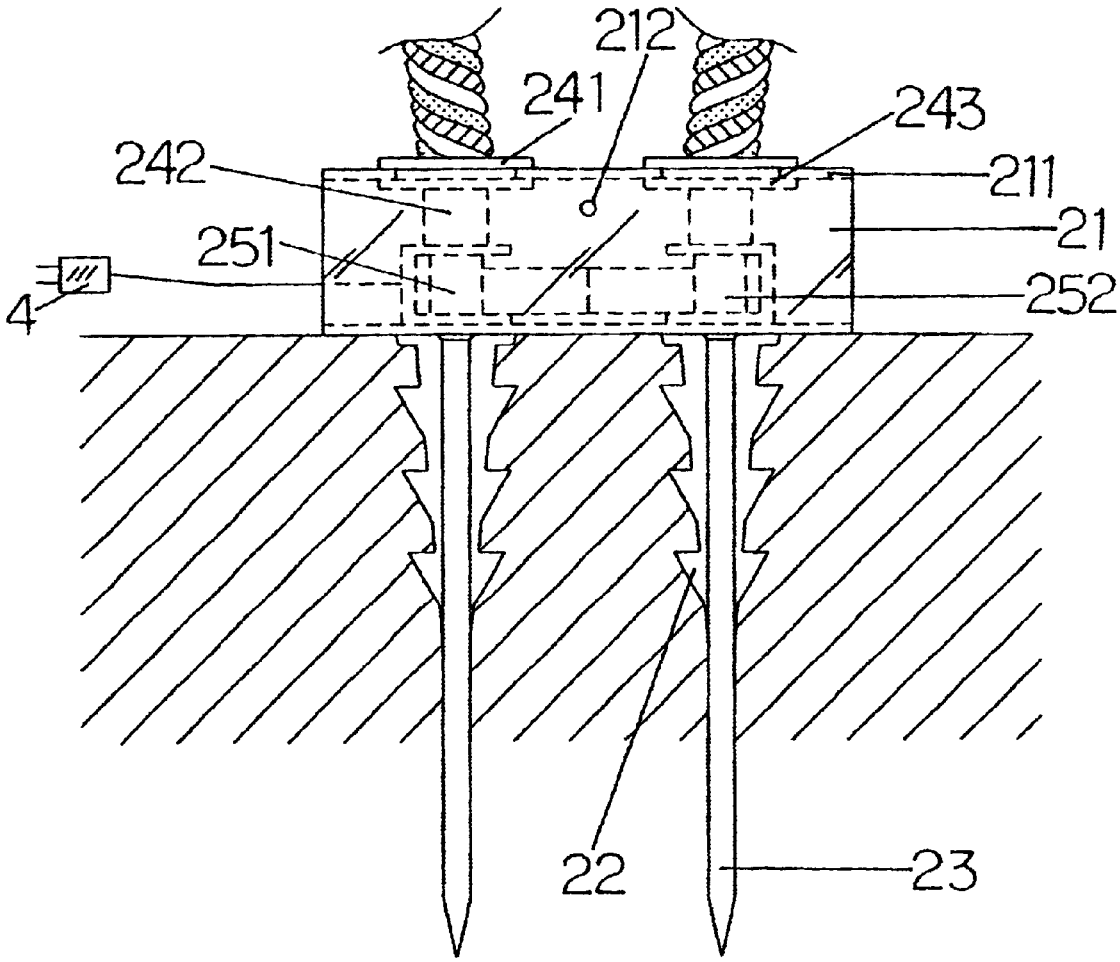
FIG. 6 is a schematic drawing of the lateral and cross-sectional view of the present invention.

Following the abovementioned, the upper end connecting joints (2511, 2521) of the connectors of type male A and type female B (251, 252) join with the lower aspect (242) of the joint (24) to make the twisted flexible lights (1) inside the joint (24) electrically conduct with the upper end connecting joints (2511, 2521), as shown in FIG. 5; then the concave slot (243) at the upper aspect of the joint (24) slides inwardly toward the bar rails (211) on two lateral planes of the slot scat (21) so as to position the joint (24) and the connector (25) inside the slot seat (21) and to conjoin the lower end connecting joints (2512, 2522) of the type male A and type female B connectors (251, 252); finally, the AC cord receptacle (4) at one end of the type male A connector (251) is plugged to the AC cord socket, thereby to make the flexible lights (1) connected to the type male A and type female B connectors (251, 252). luminesce, as shown in FIG. 6.

Figure 7:
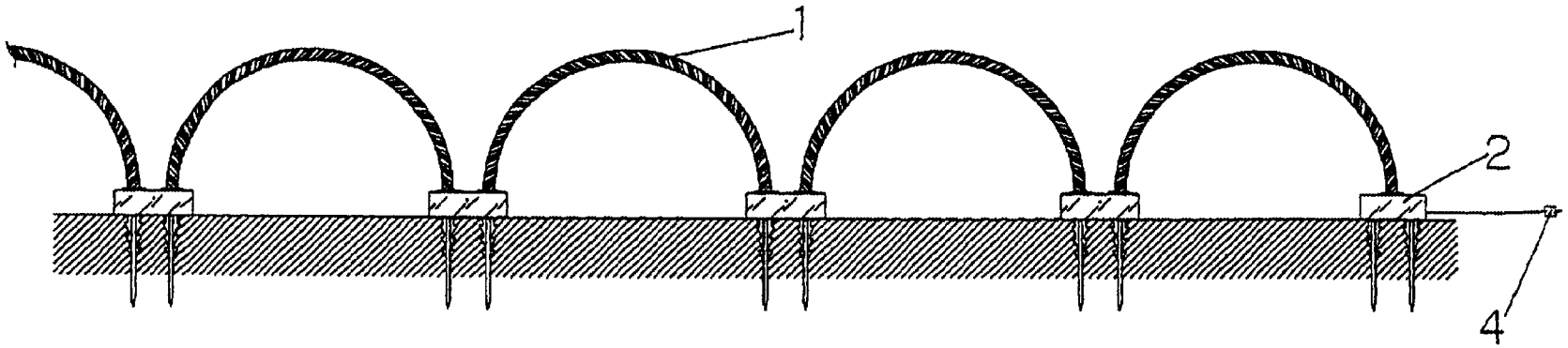
FIG. 7 is a drawing of an exemplary embodiment of the arcuate shapes of the flexible lights of the present invention.

The present invention twists two or three strands of flexible lights (1) spread with pearlescent pigments together to form a colorful flexible light in an arcuate shape to cooperate with the design of a vertically buried connector (2), as shown in FIG. 7; first, a plurality of vertically buried connectors (2) are nailed into the ground, then two ends of the twisted flexible lights (1) arc respectively mounted onto the front and the rear vertically buried connectors (2); the first vertically buried connector (2), either on the left or on the right side, has a set of type male A connector (251) installed inside, additionally, all the other vertically buried connectors (2) are also installed with the type male A and type female B connectors (251, 252); however, this type male A connector (251) does not require AC cord; the lower end connecting joint (2512) of the type male A connector (251) conjoins with the lower end connecting joint (2522) of the type female B connector (252) to make the AC cord receptacle (4) at one end of the type male A connector (251) plug into an electric socket for conducting electricity so as to make the flexible lights (1) luminesce; it is different from the conventional flexible light that it dose not require a separate AC cord for each segment or group of flexible lights; it is power saving, economic and efficient.

Figure 8:
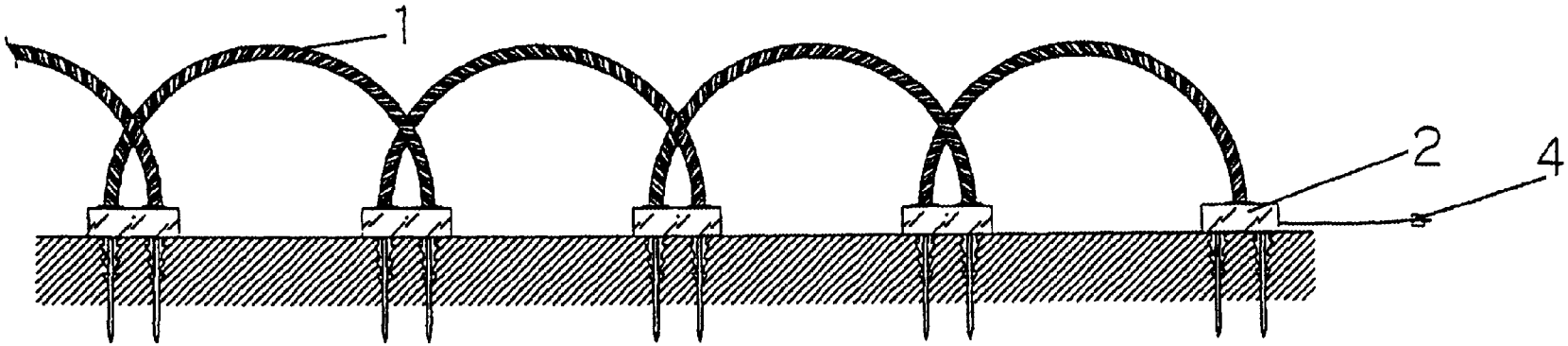
FIG. 8 is a drawing of an exemplary embodiment of the crisscrossed arcuate shapes of the flexible lights of the present invention.

According to the abovementioned, the present invention can be crisscrossed into arcuate shapes, as shown in FIG. 8; first, a plurality of vertically buried connectors (2) are nailed into the ground, then two ends of the twisted flexible lights (1) are respectively mounted onto the front and the rear vertically buried connectors (2); wherein the front ends of the flexible lights (1) are mounted onto the type male A connector (251) of the vertically buried connector (2) while the rear ends of the flexible lights (1) are mounted onto the type female B connector (252) of the vertically buried connector (2) the first vertically buried connector (2), either on the left or on the right side, has a set of type male A connector (251) installed inside, additionally, all the other vertically buried connectors (2) are also installed with the type male A and type female B connectors (251, 252); however, this type male A connector (251) does not require AC cord; the lower end connecting joint (2512) of the type male A connector (251) conjoins with the lower end connecting joint (2522) of the type female B connector (252) to make the AC cord receptacle (4) at one end of the type male A connector (251) plug into an electric socket for conducting electricity so as to make the flexible lights (1) luminesee.

Figure 9:
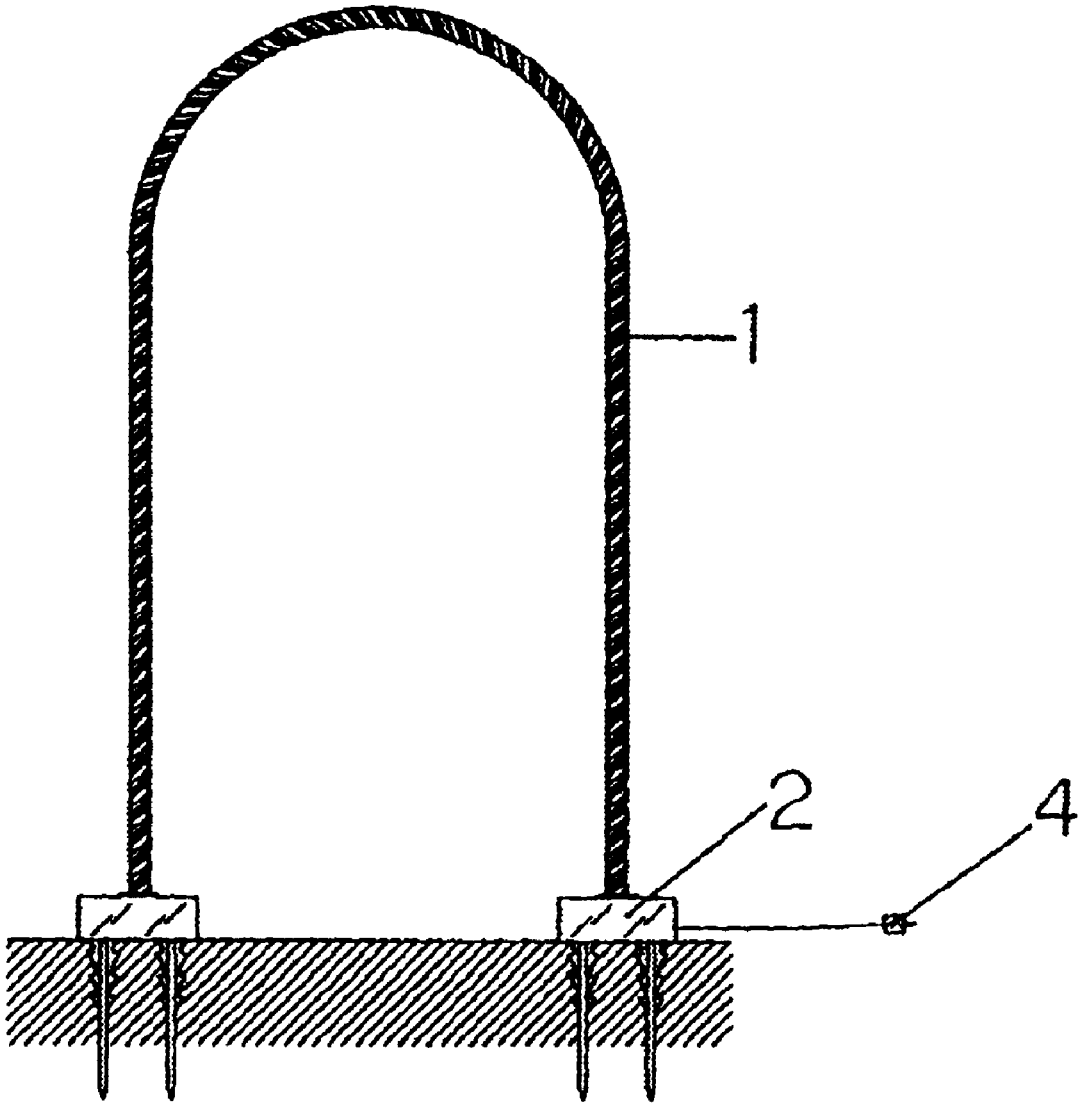
FIG. 9 is a drawing of an exemplary embodiment of the arch shapes of the flexible lights of the present invention.

Following the abovementioned, the present invention can be formed in an arch shape, as shown in FIG. 9; the required movement is the same as that for forming an arcuate shape; it only elongates the twisted arcuate flexible lights (1) into an arch shape.

In summation of the abovementioned, the present invention of a structure of twisted flexible lights can be applied to the roadsides, the walls, the gardens or the arches with a plurality of variable styles; furthermore, since the surfaces of the flexible lights are spread with pearlescent pigments not easy to fade, thereby the present invention is more colorful and gorgeous with enhanced visional effect and also possesses more practical and economic efficiency.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A buried connector for twisted flexible lights comprising:

a slot seat that is "U" shaped having upper rims of two lateral planes thereof extending inwardly to form bar rails;

a plurality of protruding holes disposed on a bottom portion of the slot seat;

a plurality of plastic pegs mounted on a lower face of the protruding holes, the plastic pegs having a first hollow area corresponding to the protruding holes;

at least one nail inserted through both one of the protruding holes and into the first hollow area of the plastic peg;

a pair of first joints each having an upper aspect, a lower aspect and a second hollow area at the center for a flexible light;

a male connector having a first upper end and a first lower end, and a female connector having a second upper end and a second lower end, the male and female connectors mounted in the slot seat in sandwiched "L" shapes and in electrical communication;

wherein the male connector is electrically connected to an AC cord;

the first upper end being disposed with a first connecting joint having electrical connection to the first upper end;

the second upper end being disposed with a second connecting joint having electrical connection to the second upper end; and the first and second connecting joints being in electrical communication with each of the pair of first joints; each of the first joints being in electrical communication with an end of at least one flexible light.

2. The buried connector for twisted flexible lights according to claim 1, wherein the slot seat being punch-made of metal material and spread with polyvinyl chloride (PVC) for antirust.

* * * * *